US006732620B1

(12) United States Patent
Brodmann et al.

(10) Patent No.: US 6,732,620 B1
(45) Date of Patent: May 11, 2004

(54) CUTTING MACHINE WITH ROTATING CUTTING BLADE

(75) Inventors: Joachim Brodmann, Hannover (DE); Uwe Kröger, Laatzen (DE); Harald Hepke, Hannover (DE)

(73) Assignee: Berstorff GmbH, Hannover (DE)

( * ) Notice: Subject to any disclaimer, the term of this patent is extended or adjusted under 35 U.S.C. 154(b) by 0 days.

(21) Appl. No.: 09/937,271

(22) PCT Filed: Mar. 24, 2000

(86) PCT No.: PCT/DE00/00944

§ 371 (c)(1),
(2), (4) Date: Sep. 24, 2001

(87) PCT Pub. No.: WO00/56507

PCT Pub. Date: Sep. 28, 2000

(30) Foreign Application Priority Data

Mar. 24, 1999 (DE) ..... 199 14 194

(51) Int. Cl.[7] ..... B26D 1/18

(52) U.S. Cl. ..... 83/48.8; 83/489; 83/614; 83/617

(58) Field of Search ..... 83/56, 42, 487, 83/488, 489, 617, 614

(56) References Cited

U.S. PATENT DOCUMENTS 1,849,825 A * 3/1932 Cutler ..... 318/161 X
3,483,784 A * 12/1969 Kaiser ..... 83/215
4,965,733 A * 10/1990 Kimura et al. ..... 700/167
5,315,398 A * 5/1994 Otsuki ..... 358/304
5,901,269 A * 5/1999 Chang ..... 388/832
6,041,683 A * 3/2000 Timperi et al. ..... 83/76

FOREIGN PATENT DOCUMENTS

DE 0284761 A1 * 2/1988 ..... B29D/30/46
DE 0518043 A1 * 4/1992 ..... B26D/1/00
EP 518043 A1 * 12/1992 ..... B26D/1/00

* cited by examiner

*Primary Examiner*—Allan N. Shoap
*Assistant Examiner*—John Windmuller
(74) *Attorney, Agent, or Firm*—Cohen, Pontani, Lieberman & Pavane

(57) ABSTRACT

The invention relates to a cutting machine, in particular a tread cutting machine, having at least one cutting blade (8) linearly traversable on a blade carriage (1) for achieving a feed movement and rotationally driven by a motor (2), the motor (2) for the drive of the cutting blade (8) being arranged outside the blade carriage (1), and a torque-transmission means, which comprises a means for transmitting tensile forces, being provided between the motor (2) and the cutting blade (8), and that part of the torque-transmission means which is traversable with the blade carriage (1) having a markedly lower mass than the motor (2). In this case, the motor (2) is provided with a device which is designed as a closed-loop control or an open-loop control and is intended for keeping the rotational speed of the cutting blade (8) at least approximately constant during a feed movement of the cutting blade (8).

7 Claims, 2 Drawing Sheets

CUTTING MACHINE WITH ROTATING CUTTING BLADE

PRIORITY CLAIM

This is a U.S. national stage of application No. PCT/DE00/00944, filed on Mar. 24, 2000. Priority is claimed on that application and on the following application: Country: Germany, Application No.: 199 14 194.0, Filed: Mar. 24, 1999.

BACKGROUND OF THE INVENTION

The invention relates to a cutting machine, in particular a tread cutting machine, having at least one cutting blade linearly traversable on a blade carriage for achieving a feed movement and rotationally driven by a motor.

DE 38 06 645 C2 discloses a transverse-cutting apparatus for textile webs which has a rotationally driven, disk-shaped cutting blade. The cutting blade is mounted on a blade carriage which is linearly traversable for achieving a feed movement. The motor for the drive of the cutting blade is firmly mounted outside the blade carriage and in relation to the drive is coupled to the cutting blade by a torque-transmission means designed as an endless belt. A further endless belt is provided in order to be able to traverse the blade carriage, and this further endless belt can likewise be driven by a motor arranged outside the blade carriage and is firmly clamped to the blade carriage.

A similar cutting apparatus for cutting foodstuffs has been disclosed by German Utility Model DE 89 04 725.7 U1.

In these apparatuses, the dynamics of the feed movement, compared with the previously conventional arrangement of the motor for the rotational drive of the cutting blade on the blade carriage, are markedly improved, since the mass of the blade carriage is reduced overall.

In the tire industry, cutting apparatuses have been used for many years for the cutting of treads, these cutting apparatuses likewise having a motor-driven cutting blade on a blade carriage traversable transversely to the tread. In this case, however, the drive motor for the cutting blade is arranged on the blade carriage, so that its mass is comparatively large and impairs the dynamics of the feed movement. Under the comparatively rough operating conditions of a tread cutting machine with its high number of stress cycles per year and its high feed rates during the cut and during idle strokes (return travel into the cutting initial position), a type of construction having a drive motor arranged outside the blade carriage leads to high loads on the mechanical drive system, which greatly reduce its service life.

SUMMARY OF THE INVENTION

The object of the invention is to improve a cutting machine of the generic type to the effect that a highly dynamic feed movement of the blade carriage is ensured with a long service life of the drive system, in which case the construction outlay required for this is to be comparatively small.

This object is achieved according to the invention by the features specified patent claim 1. Advantageous developments of the invention are specified in the subclaims.

The present invention is based on the knowledge that the mass of the drive system, normally designed as an electric motor, for the rotating cutting blade constitutes the essential determining factor for the total mass of the blade carriage in the hitherto conventional design. The invention breaks away from the idea that the drive motor absolutely has to be arranged on the blade carriage and traversed together with the latter and instead provides for the motor for the blade drive to be arranged outside the blade carriage, i.e. in a fixed position. For the transmission of the torque from the motor to the cutting blade, a torque-transmission means is provided, this torque-transmission means being characterized by the fact that part of the torque-transmission means which has to be traversed with the blade carriage has a markedly lower mass than the motor installed in a fixed position. As a result, a drastic reduction in the total weight of the blade carriage can be achieved. This reduction in weight in turn permits a considerable improvement in the dynamics of the feed movement, since the forces for the acceleration or braking of the blade carriage turn out to be correspondingly markedly lower.

The invention relates to a cutting machine, in particular a tread cutting machine, having at least one cutting blade linearly traversable on a blade carriage for achieving a feed movement and rotationally driven by a motor.

However, it should be taken into account that, during a traverse of the blade carriage in the direction of the movement of the revolving torque-transmission means, a reduction in the drive speed of the cutting blade occurs on account of the superimposed movement, whereas, conversely, during a traverse of the blade carriage against the direction of movement of the revolving torque-transmission means, an increase in the rotational speed of the cutting blade occurs. This variation of the rotational speed lies within a range of up to +/−30% of the rated speed. On the one hand, during the cutting phase, such a change in the rotational speed may lead to losses of quality during the cutting. On the other hand, the forces caused by the braking or acceleration of the rotating blade mean a considerable additional load, which would reduce the service life of the mechanical drive system. The invention therefore provides for the motor for the rotary drive of the cutting blade to be provided with a device which ensures that the rotational speed of the cutting blade is kept at least approximately constant during a feed movement of the cutting blade. This should be ensured in particular when the cutting blade is just in cutting engagement. The rotational speed of the cutting blade is preferably kept completely constant continuously. This can be effected in a particularly simple manner by an actual-value detection of the blade.

Alternatively, instead of a closed-loop speed control, an open-loop control of the blade rotational speed may also be provided, the motor of the blade being controlled as a function of the desired value of the feed rate, the feed direction and the transmission ratio of the toothed belt. In both the case of a closed-loop control and an open-loop control, the invention brings about a drastic reduction in the mechanical loads of the belt drive (e.g. toothed belt) due to the fact that there are no acceleration forces (no variation in the blade rotational speed). This has a considerable effect on the reliability of a trouble-free operation without repairs especially on account of the high number of cutting operations, which is around 7 million pieces/annum for example.

For a cutting operation of high quality, it is often important for the cutting direction to always remain the same. This means that, after a feed movement of a cutting operation, a corresponding idle stroke back into the initial position of the blade carriage regularly has to be effected. So that the material to be cut is not damaged by the idle stroke, provision is advantageously made in a manner known per se for the cutting machine according to the invention to be equipped with a swinging device, by means of which the cutting blade can be brought from the cutting position into a neutral position by a tilting movement, and vice versa. To actuate this swinging device, a hydraulic or pneumatic cylinder system, for example, may be provided. In this case, the tilting movement is effected about an axis which is oriented essentially coaxially to the direction of movement of the torque-transmission means. As a result, only corresponding slight twisting of the torque-transmission means occurs during the tilting, and this twisting can easily be tolerated and neither disturbs the torque transmission nor leads to impairment of the torque-transmission means itself.

In order to be able to adapt the cutting angle to the respective requirements, a setting device for setting the cutting angle of the cutting blade is advantageously provided in a manner likewise known per se, it being possible for this setting device to be likewise operable by a hydraulic or pneumatic cylinder system for example.

BRIEF DESCRIPTION OF DRAWINGS

The invention is explained in more detail below with reference to the exemplary embodiment shown in the drawing, in which.

DESCRIPTION OF THE PRESENTLY PREFERRED EMBODIMENTS

Figure 1:
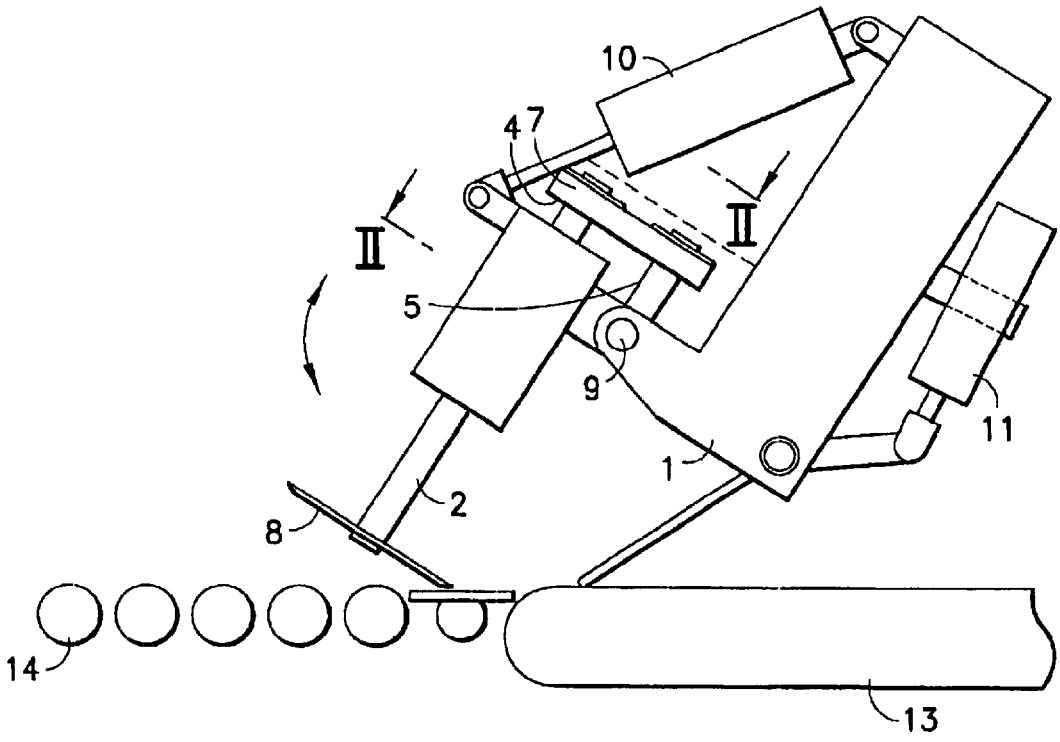
FIG. 1 shows a side view of a cutting machine according to the invention, the blade drive motor not being depicted.
Figure 2:
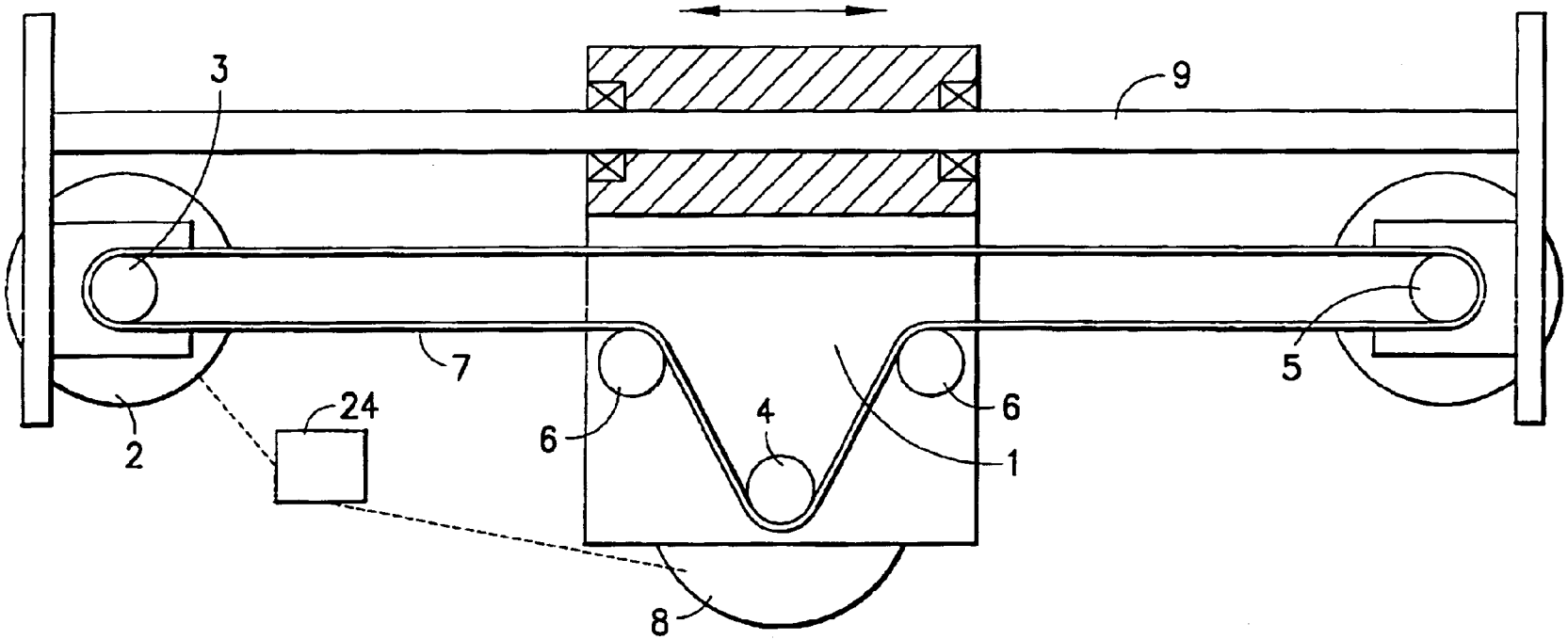
FIG. 2 shows a plan view of the blade carriage of the cutting machine in FIG. 1.

The cutting machine shown schematically in FIG. 1 is intended for cutting treads to size in the course of the manufacture of vehicle tires. The treads are transported from the right via a conveyor belt 13 right into the cutting region of the cutting machine and are divided there transversely to the transport direction. The cut-off sections of the treads, after the cutting, are each transported via a system of conveyor rollers 14 for further processing. The main item of the cutting machine consists of the blade carriage 1, the precise construction of which can be better seen from the plan view of FIG. 2. The blade carriage 1 is traversable along a pivot axis 9 by a linear unit which moves the blade carriage in a linear direction and includes a drive motor 2 and a revolving toothed belt 7 (The linear unit is described in more detail below). The pivot axis 9 is part of a portal-like superstructure 26, i.e., a superstructure shaped like the frame of a portal or doorway, including sides 28*a*, 28*b*. The pivot axis is connected between the sides 28*a*, 28*b* to form the portal-like superstructure 26. Arranged on the blade carriage 1 is a rotating blade 8, the cutting plane of which is inclined at an angle to the transport plane of the treads, as can be seen from FIG. 1. A feed movement, which is directed-transversely to the transport plane of the treads, is produced for the cutting operation by the linear unit. This produces sections of the treads, which each have a cut surface running in a wedge shape at their ends. The entire blade carriage 1 and the linear unit can be pivoted about a pivot axis 9, so that the cutting angle can be adapted to the respective requirements. FIG. 2 shows a partial cross-section where the blade carriage 1 is connected to the pivot axis 9. Since a variation in the setting of the cutting angle has to be effected only infrequently, this means of setting can preferably be carried out manually. During the cutting, the tread to be cut is fixed in its position by a hold-down which can be actuated by means of, for example, a pneumatic pressure-cylinder system 11.

The rotating blade 8 is fastened to the blade carriage 1 at the bottom end of an upright blade shaft 20, which is set at a slight angle to the vertical in accordance with the desired cutting angle. In the region of the other end of the blade shaft, a toothed disk 4 is connected to the blade shaft in a rotationally fixed manner. The drive motor 2, preferably an electric motor, is arranged in a fixed position in the left-hand part of the portal-like superstructure 26, as can be seen from FIG. 2. At its drive shaft, the motor 2 is provided with a drive pulley 3, which drives a revolving toothed belt 7. The toothed belt 7 runs rectilinearly from the drive pulley 3 up to a deflection pulley 5 on the opposite right-hand side of the portal-like superstructure, is deflected there by 180° at the deflection pulley 5 and returns via the blade carriage 1 to the drive pulley 3. In the region of the blade carriage 1, the returning part of the revolving toothed belt 7 is guided via the toothed disk 4 for the blade drive and two deflection pulleys 6 arranged symmetrically on both sides of the toothed disk 4. In this way, the toothed belt is in engagement with the toothed disk 4 over a circumferential angle of more than 90° (in the exemplary embodiment shown).

If the blade carriage 1 is traversed via the linear unit by the motor 2 when the drive is running, depending on the direction of the linear traverse of the blade carriage 1, at a constant rotational speed of the motor 2, a higher or a lower rotational speed occurs at the drive shaft of the rotating blade 8, depending on whether the linear traverse is effected against the direction of movement of the driving part of the toothed belt 7 or in the direction of movement of the toothed belt 7. In order to ensure as constant a rotational speed as possible during a feed movement, in particular during the actual cutting engagement of the blade 8, the cutting machine according to the invention is preferably provided with a closed-loop speed control of the motor 2, this closed-loop speed control, if need be, increasing or decreasing the drive speed of the motor 2 via an actual-value detection of the rotational speed of the blade 8 in order to ensure a constant rotational speed of the blade 8 and to avoid the loads which otherwise occur on the toothed belt 7 due to acceleration forces. The motor 2 is provided with a device 24 depicted schematically in FIG. 2, which, e.g., detects speed of the rotating blade 8 and motor speed accordingly is controlled based on the detected blade speed. Alternatively, an open-loop control of the blade rotational speed as a function of the movement parameters of the toothed-belt drive and of the linear unit may also be provided.

As a rule, it is desirable for the cutting of individual treads to always be carried out in each case in the sane direction of the feed movement in order to ensure a uniform cutting quality. For this reason, the blade carriage 1 must in each case be returned into its initial position after performing a cutting operation. So that the blade 8, which continues to rotate, during such an idle stroke for reaching the initial position, does not damage a tread which has just been transported through the cutting region, the rotating blade 8 is swung out of its cutting position into a neutral position. Provided for this purpose is a pivoting cylinder 10, which pivots the blade 8 with the blade shaft and toothed disk 4 about a pivot axis 9, so that the blade 8 is disengaged and can be safely moved across the tread. This pivoting operation leads merely to slight twisting of the toothed belt 7 in the region of its parts lying parallel to the feed direction. By means of the revolving toothed belt 7, a solution which is exceptionally simple in terms of construction for reliable transmission of the torque from the drive motor 2 to the blade shaft of the blade 8 is ensured. A similar effect could be achieved with a chain drive or with a revolving cable. The device provided according to the invention for keeping the blade rotational speed constant ensures a long service life of the mechanical drive of the cutting blade.

By the arrangement according to the invention of the drive motor at a location outside the moving blade carriage, it is possible to reduce the weight of the blade carriage by about 40% compared with the conventional type of construction of tread cutting machines, which provides an arrangement of the motor on the blade carriage. As a result of the drastic saving in weight and by keeping the blade rotational speed constant, the forces for the acceleration or the braking of the blade carriage are considerably lower. As a result, it is possible to markedly increase the speed for the traverse of the blade carriage, in particular during an idle stroke for reaching the initial position, so that the productive capacity of the entire cutting machine can be considerably increased in this way.

What is claimed is:

1. A tread cutting machine, comprising:

at least one cutting blade;

a blade carriage, said cutting blade being mounted on said blade carriage, said blade carriage being linearly traversable for correspondingly moving said cutting blade in a feed movement;

a drive motor outside said blade carriage; and torque-transmission means arranged between said drive motor and said cutting blade for driving a rotation of said cutting blade and selectively moving said cutting blade in the feed movement direction during rotation of said cutting blade such that the feed movement is superposed with the rotation of said cutting blade in said torque-transmission means, at least a part of said torque-transmission means being traversable with said blade carriage, said torque-transmission means part having a lower mass than said drive motor, said motor having one of a closed-loop control device and an open-loop control device for maintaining a rotational speed of said cutting blade substantially constant during cutting blade feed movement.

2. A cutting machine according to claim 1, wherein said closed-loop control device is an actual rotational speed detector.

3. A cutting machine according to claim 1, wherein said cutting blade is affixed to a drive shaft said torque-transmission means comprising a rotary toothed belt, and a toothed disk on said drive shaft, said toothed disk interacting with said rotary belt to drive said cutting blade.

4. A cutting machine according to claim 1, wherein a direction of movement of said transmission means is substantially parallel to said cutting blade feed movements.

5. A cutting machine according to claim 1, wherein said cutting blade is moveable between cutting and noncutting positions, a movement of said cutting blade between said positions being a tilting movement.

6. A cutting machine according to claim 1, wherein said blade carriage is pivotable for setting a cutting angle of said cutting blade.

7. A method for cutting treads for vehicle tire manufacturing to a size such that a cut surface forms a wedge shape at tread ends, comprising performing said tread cutting utilizing the cutting machine of claim 1.

* * * * *